US007000438B1

(12) United States Patent
Cooper et al.

(10) Patent No.: US 7,000,438 B1
(45) Date of Patent: Feb. 21, 2006

(54) RESTRAINT SYSTEM AND LOCKABLE FASTENER

(75) Inventors: Jeffrey A. Cooper, Butler, PA (US); Daniel T. Hilliard, Butler, PA (US); D. Patrick Jones, Sarver, PA (US); Jimmy Warnell, McKinney, TX (US); Randy Norton, McKinney, TX (US); Tim Quintana, Sachse, TX (US)

(73) Assignee: Restraint Systems Technologies, Inc., Cabot, PA (US)

( * ) Notice: Subject to any disclaimer, the term of this patent is extended or adjusted under 35 U.S.C. 154(b) by 226 days.

(21) Appl. No.: 10/151,725

(22) Filed: May 20, 2002

(51) Int. Cl.
*E05B 75/00* (2006.01)

(52) U.S. Cl. ..... 70/16; 128/869; 128/878; 70/18

(58) Field of Classification Search ..... 70/14–16, 70/18, 19, 30, 49, 64, 69; 128/869, 878
See application file for complete search history.

(56) References Cited

U.S. PATENT DOCUMENTS

| | | | | | |
|---|---|---|---|---|---|
| 380,441 | A | * | 4/1888 | Hyatt et al. | 70/16 X |
| 583,796 | A | * | 6/1897 | Ferrell | 70/16 X |
| 735,689 | A | | 8/1903 | Adams | |
| 1,047,457 | A | * | 12/1912 | Steimer | 70/16 X |
| 2,324,183 | A | * | 7/1943 | Wilson | 70/16 |
| 2,425,489 | A | * | 8/1947 | Peterson | 128/134 |
| 2,570,662 | A | | 10/1951 | Gray | 70/16 |
| 3,592,028 | A | | 7/1971 | La Monica | 70/57 |
| 4,233,713 | A | | 11/1980 | Berg | 24/191 |
| 4,237,708 | A | * | 12/1980 | Bremer, Jr. | 70/16 |
| 4,287,731 | A | | 9/1981 | Kruger | 70/16 |
| 4,561,437 | A | | 12/1985 | Kirchner | 128/327 |
| 4,574,600 | A | | 3/1986 | Moffett | 70/16 |
| 4,685,315 | A | | 8/1987 | Comolli | 70/68 |
| 4,860,560 | A | * | 8/1989 | Lundelius | 70/16 |
| 4,949,679 | A | * | 8/1990 | Wolfer | 128/878 |
| 5,117,663 | A | * | 6/1992 | Ida | 70/64 |
| 5,345,947 | A | * | 9/1994 | Fisher | 70/16 X |
| 5,400,623 | A | * | 3/1995 | Bota | 70/16 |
| 5,469,813 | A | * | 11/1995 | Peden | 70/16 X |
| 5,542,433 | A | | 8/1996 | Saupe | 128/869 |
| 5,551,447 | A | | 9/1996 | Hoffman et al. | 128/869 |
| 5,581,853 | A | * | 12/1996 | Miller et al. | 70/16 X |
| 5,829,443 | A | * | 11/1998 | Cunningham | 70/16 X |
| 6,000,249 | A | * | 12/1999 | Wilber | 70/16 |
| 6,189,348 | B1 | * | 2/2001 | Huang | 70/18 |
| 6,199,412 | B1 | * | 3/2001 | Kennedy | 70/18 |
| 6,360,747 | B1 | * | 3/2002 | Velarde et al. | 70/16 X |

OTHER PUBLICATIONS

RIPP Restraints Inc. Sales literature showing prior art restraints.
Humane Restraints Sales literature showing prior art restraints.
Plaintiff's Original Petition filed in the district court of Collin County, Texas, 401 Judicial District, No. 401–2383–02.
Original Answer and Special Exceptions of Defendant Restraint System Technologies, L.L.C. to Plaintiff's Original Petition filed in the district court of Collin County, Texas, 401 Judical District, No. 401–2383–02.

* cited by examiner

*Primary Examiner*—Suzanne Dino Barrett
(74) *Attorney, Agent, or Firm*—Andrew J. Cornelius

(57) ABSTRACT

A restraint system includes a wrist restraint system and an ankle restraint system that allow the limbs of a detainee to be restrained. The lockable wrist restraint system includes a waist belt and wrist restraints that are rotatably mounted to the waist belt. The wrist restraints can be positioned anywhere around the waist belt. The lockable ankle restraint system includes a strap and two buckles that form the strap into two loops. Each loop is used to restrain a leg of the detainee. A lockable buckle includes a housing that creates a tortuous path that traps a strap to which the buckle is mounted and prevents the strap from being adjusted or removed from the detainee.

11 Claims, 8 Drawing Sheets

RESTRAINT SYSTEM AND LOCKABLE FASTENER

BACKGROUND OF THE INVENTION

The present invention relates to restraints for controlling the movements of detainees and, more particularly, to a restraint system and buckle.

Handcuffs are commonly used by law enforcement organizations to restrain detainees who have been taken into custody. However, handcuffs are typically made of metal, and they can injure a detainee's wrists or arms as they are processed through the law enforcement system. Also, simple handcuffs do not prevent the detainee from moving his hands and arms in ways that could harm other personnel or aid in his escape. Accordingly, systems have been used that allow the handcuffs to be secured to a belt, or other apparel, that is worn by the detainee. However, it is desirable to allow a detainee some controlled arm or hand movement for some purposes like signing forms and using the lavatory.

SUMMARY OF THE INVENTION

Because the preferred embodiment of the present invention conforms to the human bone, it gives added security, and can be used to effectively and more comfortably restrain the limbs of a detainee than metal handcuffs, which cause metal to come into contact with and chafe the detainee's skin and bear against the bones of the detainee's limbs. The preferred embodiment can be adjusted easily to fit large and small individuals, and is effective for courtroom appearances by the detainee. Additionally, the wrist restraints of the preferred wrist restraint system provided by the present allow adjustment of the position of the hands to permit the detainee to accomplish various necessary tasks, while the wrists of the detainee remain restrained by the wrist restraints. Adjustment of the wrist restraints includes adjusting the position of the restraints on the waist belt of the preferred embodiment and 360° rotation of the wrist restraints. Additionally, a single standard handcuff key can be used to lock and unlock the preferred embodiment. The straps of the preferred embodiment cannot be moved to tighten or loosen the ankle and wrist restraints when a buckle associated with a strap is locked. Retention of the strap is not dependent on clamping the belt, and, thus, the preferred fastener eliminates the eccentrics, cams and interference mechanisms of known fasteners for holding straps. Additionally, the straps of the preferred embodiment can be adjusted to restrain the area of a detainee's arm anywhere from the wrist to the upper arm area. The preferred fastener eliminates the double locking procedure that is necessary in most known metallic handcuffs. The preferred restraint system is also more humane in appearance in that it eliminates chains and metallic handcuffs, and it can be more easily concealed than chains and cuffs. The preferred embodiment of the restraint system can be fitted to a restraint board or a bed, and can be used for ambulatory restraints.

The lockable fastener provided by the present invention does not require holes to be punched in the straps that are mounted on the fasteners, but rather define a tortuous path that traps the strap and prevents its adjustment. Further, the locking mechanism of the preferred fastener is enclosed in a housing for added security. The use of 4 rivets to attach the locking mechanism to the inside of the housing of the preferred fastener provides additional security. Also, the preferred fastener includes two independent locking bars on each side of the housing to increase security. If one bar is compromised, the other bar remains engaged. These locking bars are protected from tampering when the preferred fastener is closed and locked.

The present invention provides a restraint system including an anchor that can be mounted to the torso of a person, a first lockable fastener operatively associated with the anchor adapted to be locked to mount the anchor to and prevent removal of the anchor from a person, and unlocked to remove the anchor from a person, a pair of wrist restraints, and a second lockable fastener operatively associated with each wrist restraint to rotatably mount the wrist constraint to the anchor. Preferably, the anchor is a waist belt, the first lockable fastener is a lockable buckle, and each wrist restraint is a strap. Also preferably, each second lockable fastener includes a buckle unit, each buckle unit including a pair of buckles that are mounted to each other for rotational movement relative to each other, the buckle unit being adapted to be locked to mount the wrist restraint to and prevent removal of the wrist restraint from the wrist of a person, and unlocked to remove the wrist restraint from the wrist of a person.

The present invention also provides a limb restraint system including a strap and a pair of lockable buckles that are used to form the straps into a pair of limb restraints, each of the buckles being adapted to be locked to mount a limb restraint to and prevent removal of a limb restraint from the limb of a person, and unlocked to remove a limb restraint from the limb of a person.

The present invention also provides a lockable belt fastener including a housing that can be moved between open and closed positions, the housing being adapted to receive a strap when the housing in the open position and a lock for selectively locking the housing in the closed position and unlocking the housing to permit moving the housing from the closed position to the open position. The housing defines a tortuous path when said housing is closed, and traps a strap within the tortuous path when the housing has received a strap and the housing is closed and locked; the strap being prevented from sliding with respect to the housing when the strap is trapped within the housing.

BRIEF DESCRIPTION OF THE DRAWINGS

The following description of the preferred embodiments may be understood better if reference is made to the appended drawing, in which.

DETAILED DESCRIPTION OF THE PREFERRED EMBODIMENT

While preferred embodiments of the present invention have been illustrated and described herein, it is to be understood that various changes may be made therein without departing from the spirit of the invention, as defined by the scope of the appended claims.

Figure 1:
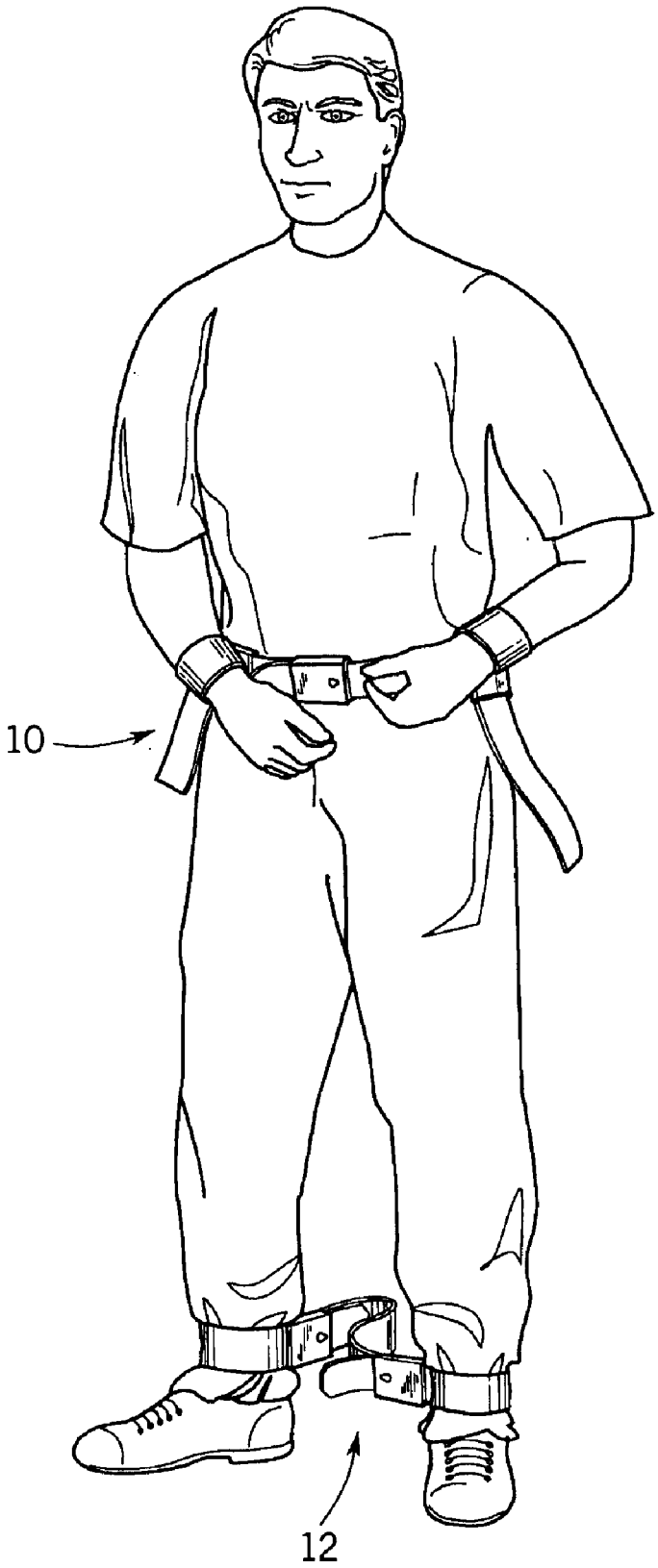
FIG. 1 is a perspective view of restraint systems provided by the present invention installed on the legs and wrists of a detainee.

FIG. 1 shows a pair of restraint systems 10 and 12 that are provided by the present invention. Wrist restraint system 10 is used to restrain the arms and hands of a detainee, while ankle restraint system 12 is used to restrain the legs and feet of a detainee. Systems 10 and 12 use locking buckles 14, 16 and 18, which also are provided by the present invention. Buckles 14, 16 and 18 can be locked and unlocked using a conventional handcuff key, as is described in more detail below to close and open the buckles and adjust systems 10 and 12 or install them on a detainee.

Figure 2:
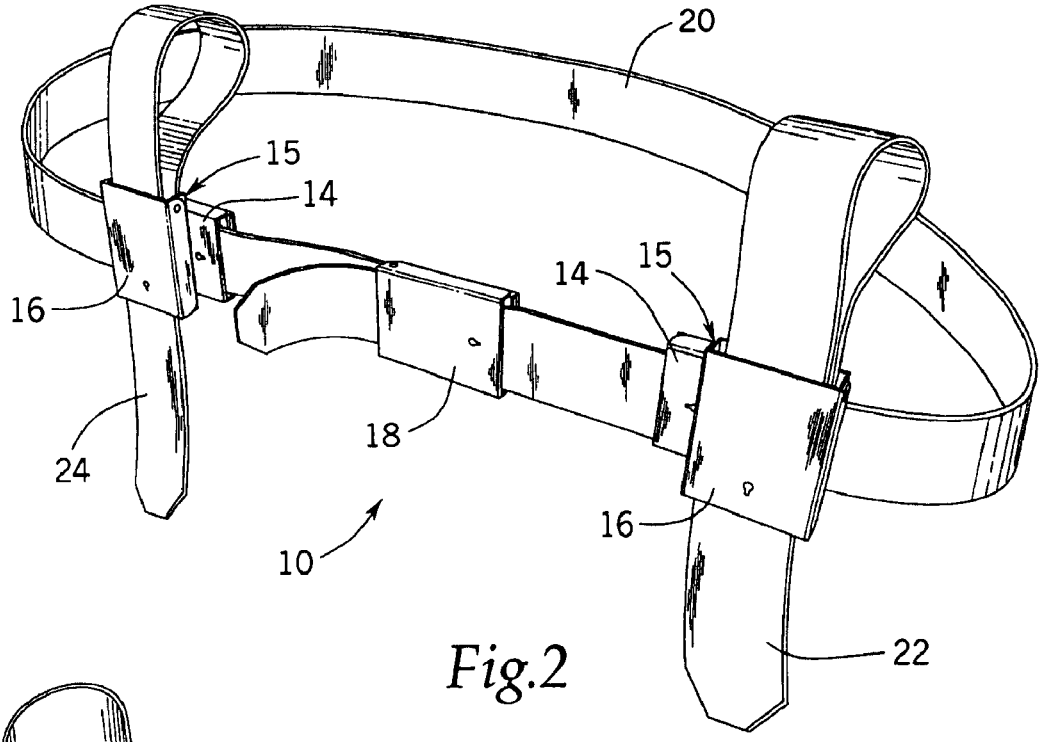
FIG. 2 is a perspective view of the wrist restraint system shown in FIG. 1.

FIG. 2 shows wrist restraint system 10, which includes a pair of buckles 14, a pair of buckles 16, a buckle 18, and straps 20, 22 and 24. Straps 20, 22 and 24 can be any suitable, known, commonly available straps. The components of buckles 14, 16 and 18 can be formed of any suitable stainless steel. Strap 20 can be tightened around the waist of a detainee using a buckle 18 by adjusting the size of the loop that is formed by strap 20 when buckle 18 is open. After tightening strap 20 around the detainee's waist, buckle 18 can be closed and locked to secure strap 20 tightly around the detainee's waist. Similarly, a buckle 16 is used to form strap 22 into a loop and tighten the loop around the left wrist of the detainee and a second buckle 16 is used to form strap 24 into a loop and tighten the loop around the right wrist of the detainee. Waist strap 20 is passed through a pair of buckles 14 when they are open. Each top buckle 16 is mounted to a bottom buckle 14, to form a buckle unit 15, in such a way that buckle 16 can pivot with respect to buckle 14. Buckles 14 can be slid along belt 20 to the positions on belt 20 at which it is desired to secure the detainee's hands, and buckles 14 can then be closed and locked to secure buckle units 15 to belt 20 and secure the detainee's hands to the detainee's waist area. Therefore, the hands of the detainee remain restrained to belt 20, but they can be rotated to facilitate accomplishing various tasks that the detainee typically needs to perform while being processed by a law enforcement organization.

Figure 3:
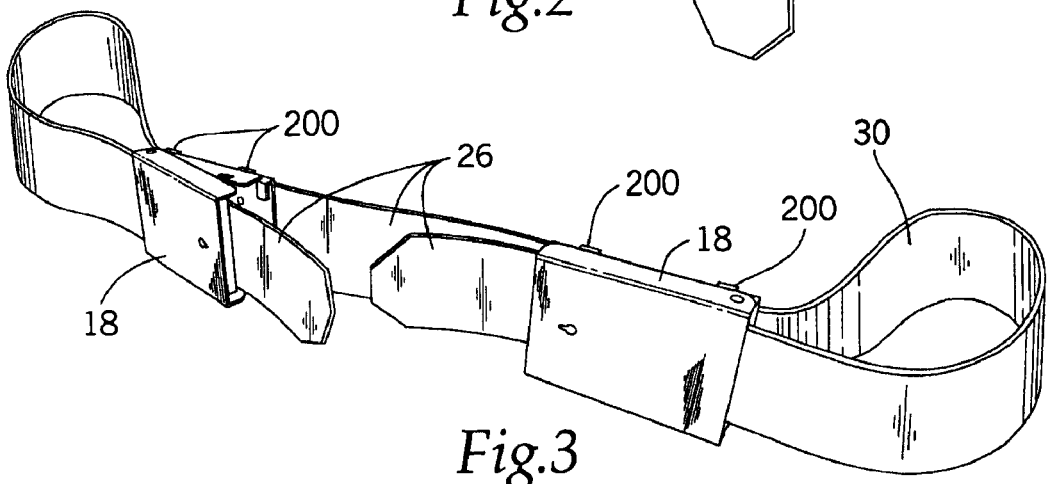
FIG. 3 is a perspective view of the ankle restraint system shown in FIG. 1.

FIG. 3 shows ankle restraint system 12, which includes a pair of buckles 18 and a strap 26. Buckles 18 are used to form two loops 28 and 30 in strap 26. Loop 28 can be tightened around the detainee's right ankle using a buckle 18 by adjusting the size of loop 28 when buckle 18 is open and then closing and locking buckle 18 after loop 28 has been tightened around the detainee's ankle. Similarly, loop 30 can be tightened around the detainee's left ankle using a second buckle 18 by adjusting the size of loop 30 when buckle 18 is open and then closing and locking buckle 18 after loop 28 has been tightened around the detainee's ankle.

Figure 10:
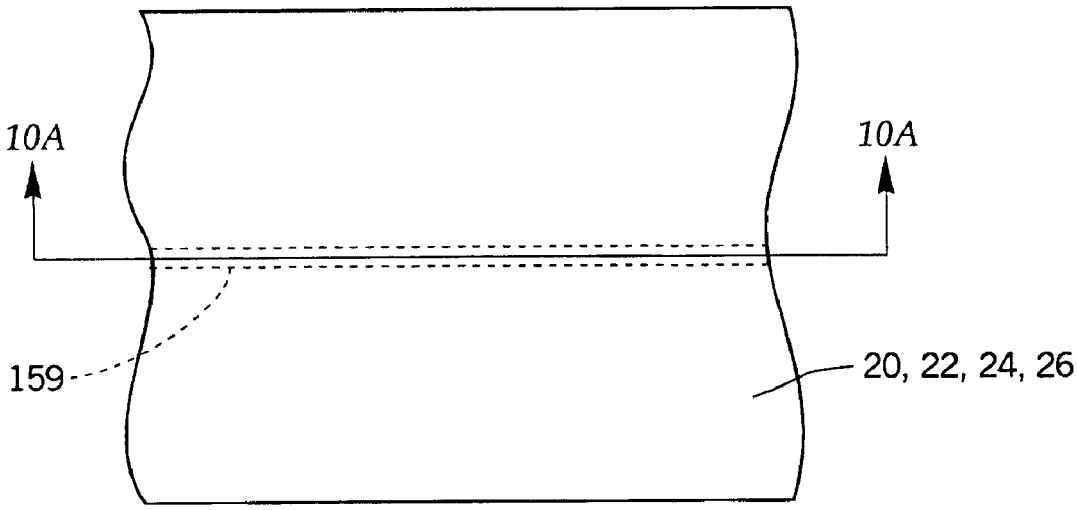
FIG. 10 is a top plan view of a section of a strap of the systems shown in FIGS. 1 and 2; and, FIG. 10A is a sectional view of the strap shown in FIG. 10 taken along the line 10A—10A.
Figure 10A:
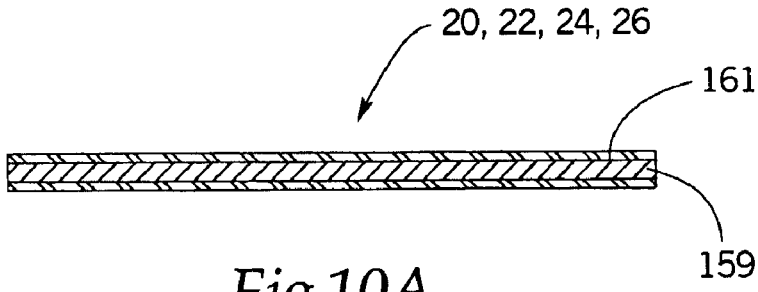

Straps 20, 22, 24 and 26 can be constructed of KEVLAR®, nylon, polyester or any other suitable strapping material. As shown in FIGS. 10 and 10A, a steel cable 159 coated with nylon 161 is embedded in each strap 20, 22, 24 and 26. Cable 159 makes it difficult for the wearer of systems 10 and 12 to cut straps 10, 22, 24 or 26 to remove all or part of systems 10 or 12 from the wearer's body.

FIGS. 4 through 9 show the construction of buckles 14, 16 and 18. Buckle 16 includes an upper base 32 and a lower base 34 that form a housing 36 in which the lock assembly 106 for buckle 16 is mounted. Upper base 32 defines a flat section 38, which defines a key opening 156, and a pair of sections 40 and 42 that depend from section 38. Lower base 34 defines a flat section 44 and a pair of sections 46 and 48 that depend from section 44. Lower base 34 also includes a belt wall 152 and support bar 153 that are used to fix a strap in place. Support bar 153 is riveted to upper housing 32 using rivets 155 and 157. Belt wall 152 can be formed from a section of section 44 that is cut and then bent upward, which also forms an opening 158. A pair of strap guides 160 and 162 are defined by or formed on walls 46 and 48, respectively. Straps inserted through housing 36 should be passed between guides 160 and 162 and section 44 of base 34. Base 34 also defines holes 166 and 168. Base bars 200 are provided, each of which defines holes 202 and 204 (see FIG. 9), that are used to rivet straps to the base 34. A strap is riveted to a buckle in system 10 by installing rivets 204 and 206 (see FIG. 9) through holes 202 and 204 in bar 200, the end of the strap, and holes 168 (as in FIG. 9) or holes 166. A hinge rivet 50 connects section 42 of upper base 32 to section 48 of lower base 34 through hole 52 formed in section 42 and hole 54 formed in section 48. A hinge rivet 56 connects section 40 of upper base 32 to section 46 of lower base 34 through hole 58 formed in section 40 and hole 60 formed in section 46. Thus, upper base 32 can pivot around rivets 50 and 56 with respect to lower base 34 to move buckle 16 between its open position and its closed and locked position, which is shown in FIGS. 4C and 5B. Buckles 14, 16 and 18 are identical with the exceptions that section 38 of buckle 14 defines a hole 178 and section 44 of buckle 16 defines a hole 180. A rivet 176 is mounted through holes 178 and 180 in such a manner that bases 32 and 34 can pivot with respect to each other.

Buckles 14 and 16 are secured to each other for full pivotal movement using a hinge rivet 176, which is inserted and installed through hole 178 in upper base 32 and hole 180 in lower base 34.

Wrist restraint system 10 is formed from a buckle 18 and a pair of buckle units 15. Generally, one end of belt 20 is riveted to the lower base 34 of a buckle 18 through holes 168, and the remaining end, or free end, of belt 20 is looped back through buckle 18. Similarly, one end of strap 22 is riveted to the lower base 34 of a buckle 16 and the remaining, or free end, of strap 22 is looped back through buckle 16. One end of strap 24 is riveted to the lower base 34 of a second buckle 16 and the remaining, or free end, of strap 24 is looped back through that buckle 16.

Figure 6A:
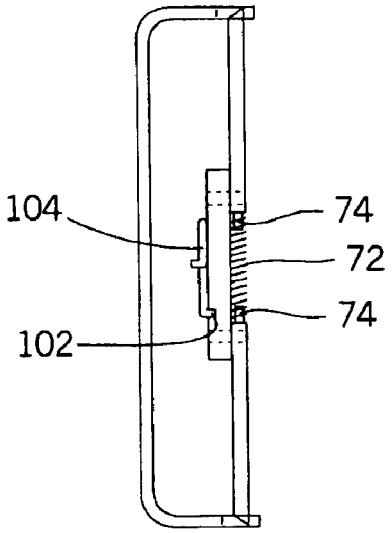
FIG. 6A is a side view of the locking mechanism of the buckle shown in FIG. 4A, with the locking elements in the extended, locking position.
Figure 6B:
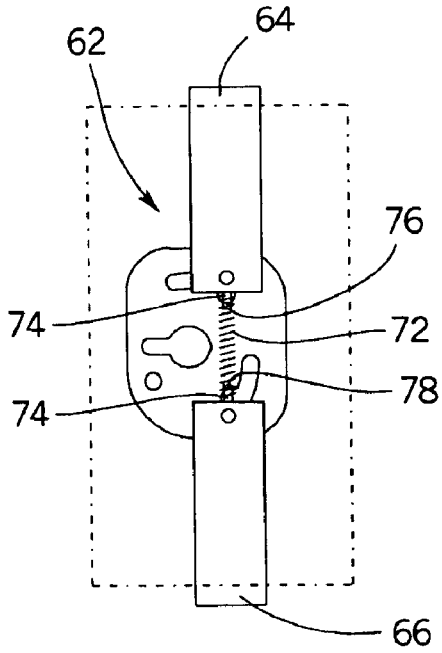
FIG. 6B is a top plan view of the locking mechanism shown in FIG. 6A.
Figure 7A:
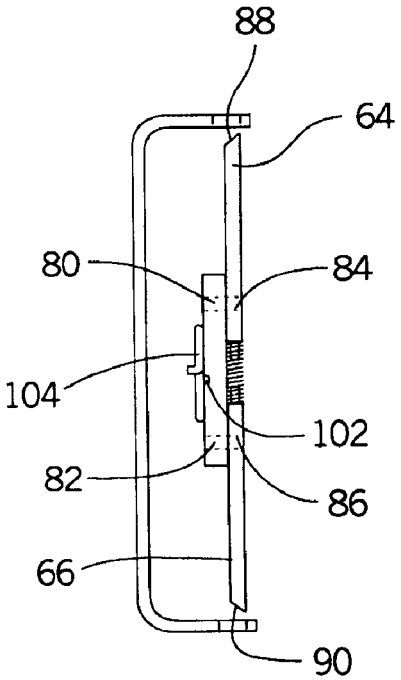
FIG. 7A is a side view of the locking mechanism shown in FIG. 6A, with the locking elements in the retracted, unlocked position.
Figure 7B:
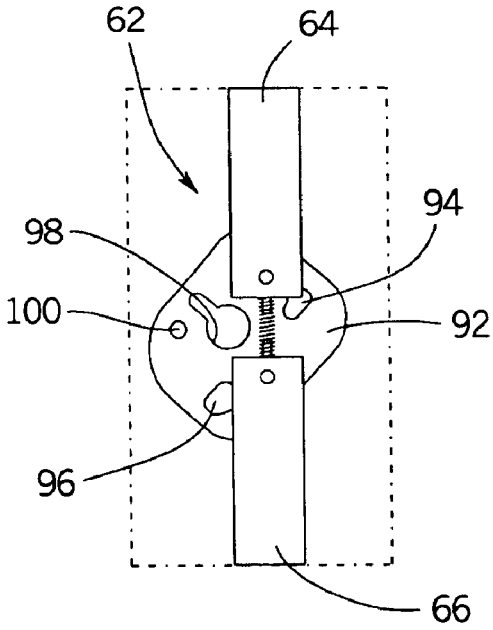
FIG. 7B is a top plan view of the locking mechanism shown in FIG. 7A.

FIGS. 6 and 7 show the locking mechanism 62 of buckles 14, 16 and 18, which is mounted to the undersurface 70 of upper base 32. FIG. 6 shows locking mechanism 62 in the locking position, and FIG. 7 shows locking mechanism 62 in the unlock position. Locking mechanism 62 includes a pair of lock elements 64 and 66. When buckle 16 is in the closed and locked position, elements 64 and 66 are in their extended positions shown in FIG. 6, in which position they extend into openings 68 formed in sides 46 and 48 of lower base 34. When elements 64 extend into openings 68, upper base 32 cannot be rotated with respect to lower base 34, and buckle 16 is locked. When elements 64 and 66 are retracted from within openings 68, upper base 32 is free to rotate with respect to lower base 34. Each of elements 64 and 66 defines a pin 74, which extend from each of the inboard ends 76 and 78 of elements 64 and 66, respectively. A compression spring 72 is friction fit onto pins 76 and 78, and biases elements 64 and 66 toward their extended positions. Downwardly extending studs 80 and 82 are friction fit into holes 84 and 86, respectively, formed in elements 64 and 66, respectively. Ends 88 and 90 of elements 64 and 66, respectively, are formed at an angle of approximately 50° to the longitudinal axes of elements 64 and 66 to facilitate entry of ends 88 and 90 into openings 68.

A lock pivot 92 is provided to move elements 64 and 66 between their extended and retracted positions. Pivot 92 defines a pair of cam slots 94 and 96, and is mounted for pivotal movement in lock mechanism 62. Lock pivot 92 also defines a key opening 98, into which the end of a handcuff key fits. With the end of the handcuff key 63 inserted in into key opening 98, cam pivot 92 can be rotated between the locked position shown in FIG. 6 and the unlock position shown in FIG. 7. As lock pivot 92 is rotated from the locking position toward the unlock position, the interior surfaces of cam slots 94 and 96 begin to pull pins 80 and 82 toward each other to move elements 64 and 66 toward the unlocking position. A key return spring 104, which is located on lock pivot 92, biases lock pivot toward its locking position.

Figure 8:
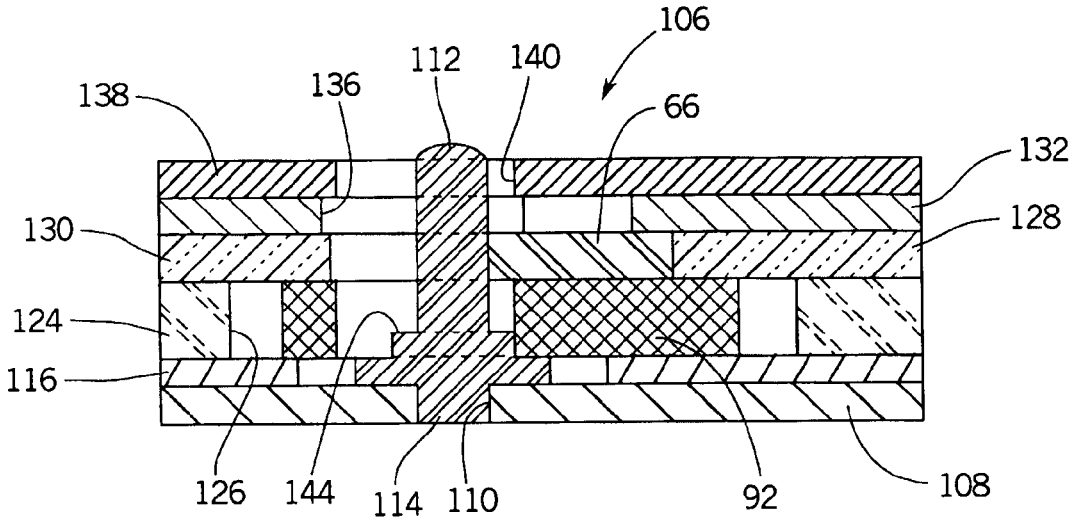
FIG. 8 is a side sectional view of the locking assembly of the buckle shown in FIG. 4A.

Lock assembly 106 is shown in FIG. 8, and includes locking mechanism 62. Assembly 106 includes a stud plate 108, which defines a hole 110. Stud 112 defines a post 114 that is mounted within hole 110 of plate 108 in any suitable manner to mount stud 112 to plate 108. The hollow end of the handcuff key receives stud 112 when the key is inserted into opening 98 of lock pivot 92 during the process of locking and unlocking buckle 16. Lock pivot 92 defines a hole 100, which receives a pin 102 defined by key return spring 104, and stud plate 108 defines a hole 120, which receives a second pin 118. Thus, key return spring 104 is mounted between stud plate 108 and lock pivot 92. Therefore, when lock pivot 92 is rotated by the handcuff key 63 to the unlock position, pins 102 and 118 move closer together, which causes spring 104 to develop a force that rotates lock pivot 92 back to its locking position when the force exerted by the key on lock pivot 92 is released during removal of the key 63 from buckle 16. A spring plate 116 is located on the upper surface of stud plate 108. Plate 116 defines a hole 122 through which spring 104 can rest on plate 108. A cam plate 124 is located on spring plate 116, and defines an opening 126, through which lock pivot 92 rests on spring plate 116. Plate 124 maintains the position of lock pivot 92. A right slide plate 128 and a left slide plate 130 are located on cam plate 124 and lock pivot 92. Plates 128 and 130 maintain the positions of elements 64 and 66. Left slide plate 130 defines a détente 142 that allows passage of the handcuff key 63 as it enters locking assembly 106. A spacer plate 132 is located on slide plates 128 and 130 and elements 64 and 66. Spacer plate 132 is provided to ensure proper clearance for elements 64 and 66 and for compression spring 78. A top plate 138 provides the upper enclosure for lock assembly 106. Plate 138 is located on spacer 132. Spacer 132 defines an opening 136 and top plate 138 defines a similar opening 140 that permits the handcuff key 63 to be inserted into locking assembly 106. Thus, the hollow end of the handcuff key 63 is inserted into locking assembly 106 through opening 140 of top plate 138, opening 136 of spacer 132, détente 142 of left slide plate 130, and opening 98 of lock pivot 92 until it is fully seated on key base 144 of stud 112.

The elements of lock assembly 106 are held together and mounted to the undersurface 70 of upper base 32 by four rivets 146 which pass through openings formed in various of the elements of lock assembly 106. Specifically, each of top plate 138, spacer 132, left slide plate 130, right slide plate 128, cam plate 124, spring plate 116, and stud plate 108 define identical rivet holes 148 which are aligned with each other when elements 138, 132, 130, 128 124, 116 and 108 are aligned properly. Therefore, lock assembly 106 is mounted to surface 70 of upper base 32 by installing rivets into upper base 32 through holes 148.

Figure 4A:
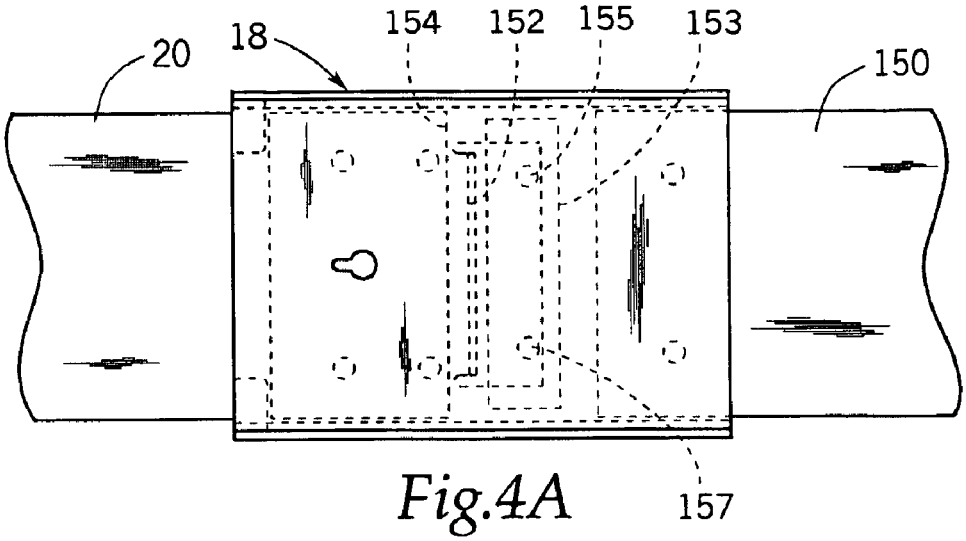
FIG. 4A is a top plan view of a buckle provided by the present invention installed on a strap of the type used in the system show in FIG. 1.
Figure 4B:
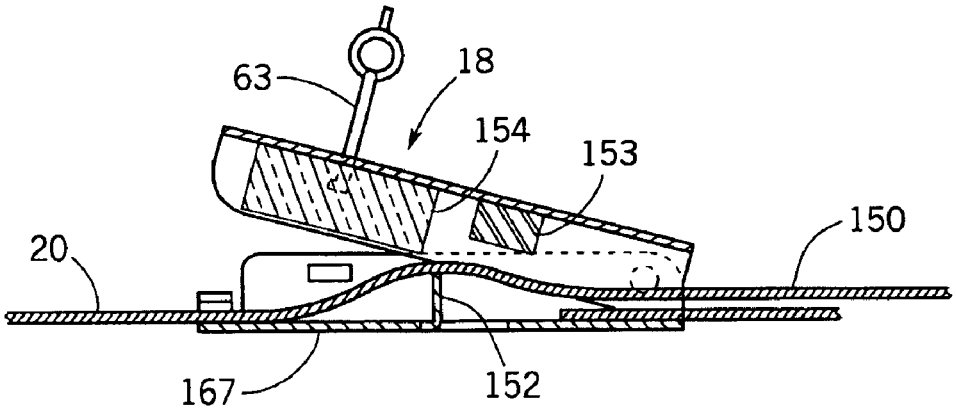
FIG. 4B is a side sectional view of the buckle and strap shown in FIG. 4A with the buckle in the unlocked and open position.
Figure 4C:
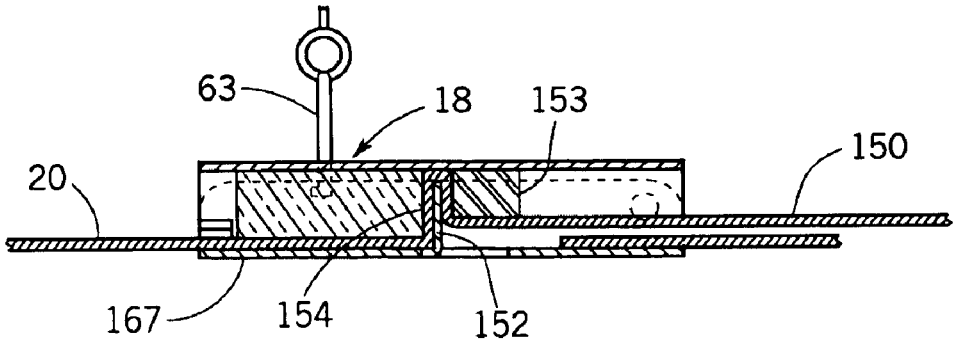
FIG. 4C is a side sectional view of the buckle and strap shown in FIG. 4A with the buckle in the closed and locked position.
Figure 5A:
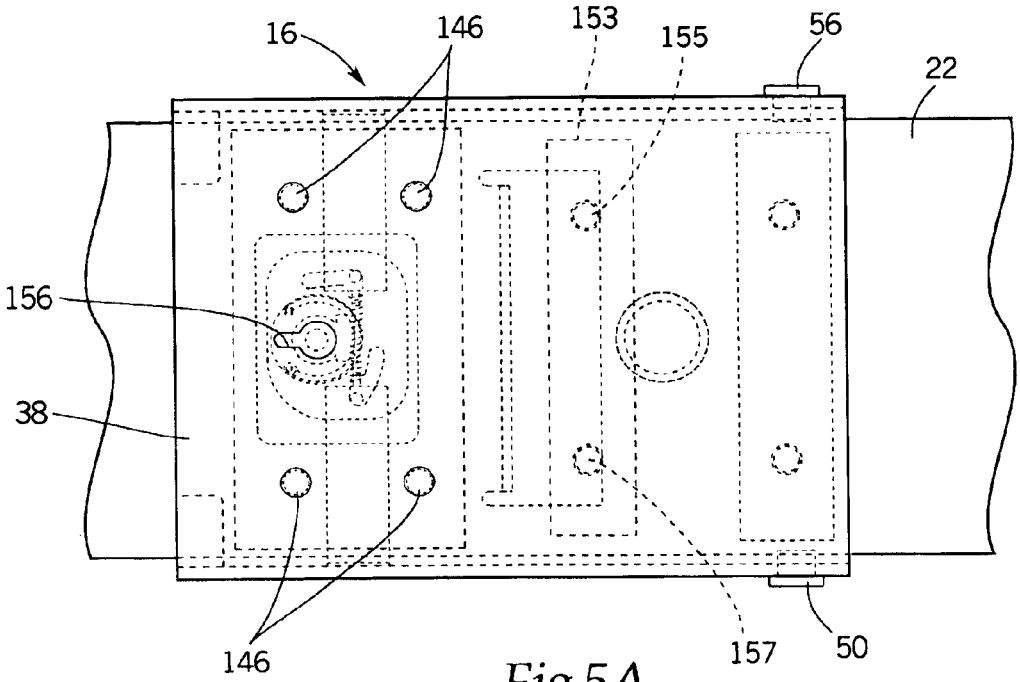
FIG. 5A is a top plan view of the buckle shown in FIG. 4A.
Figure 5B:
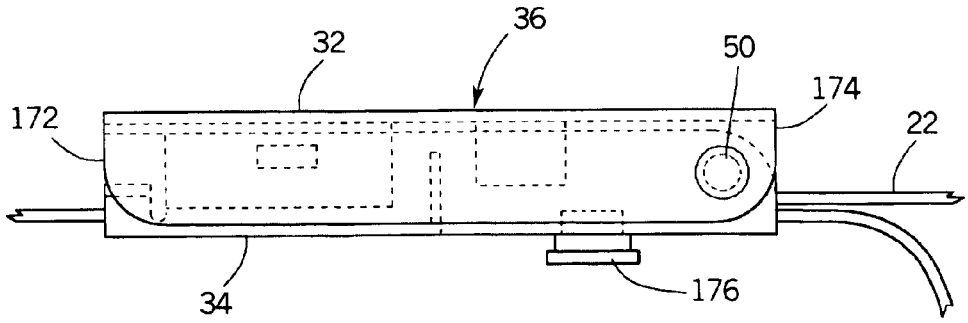
FIG. 5B is a side view of the buckle shown in FIG. 5A installed on a strap.
Figure 9:
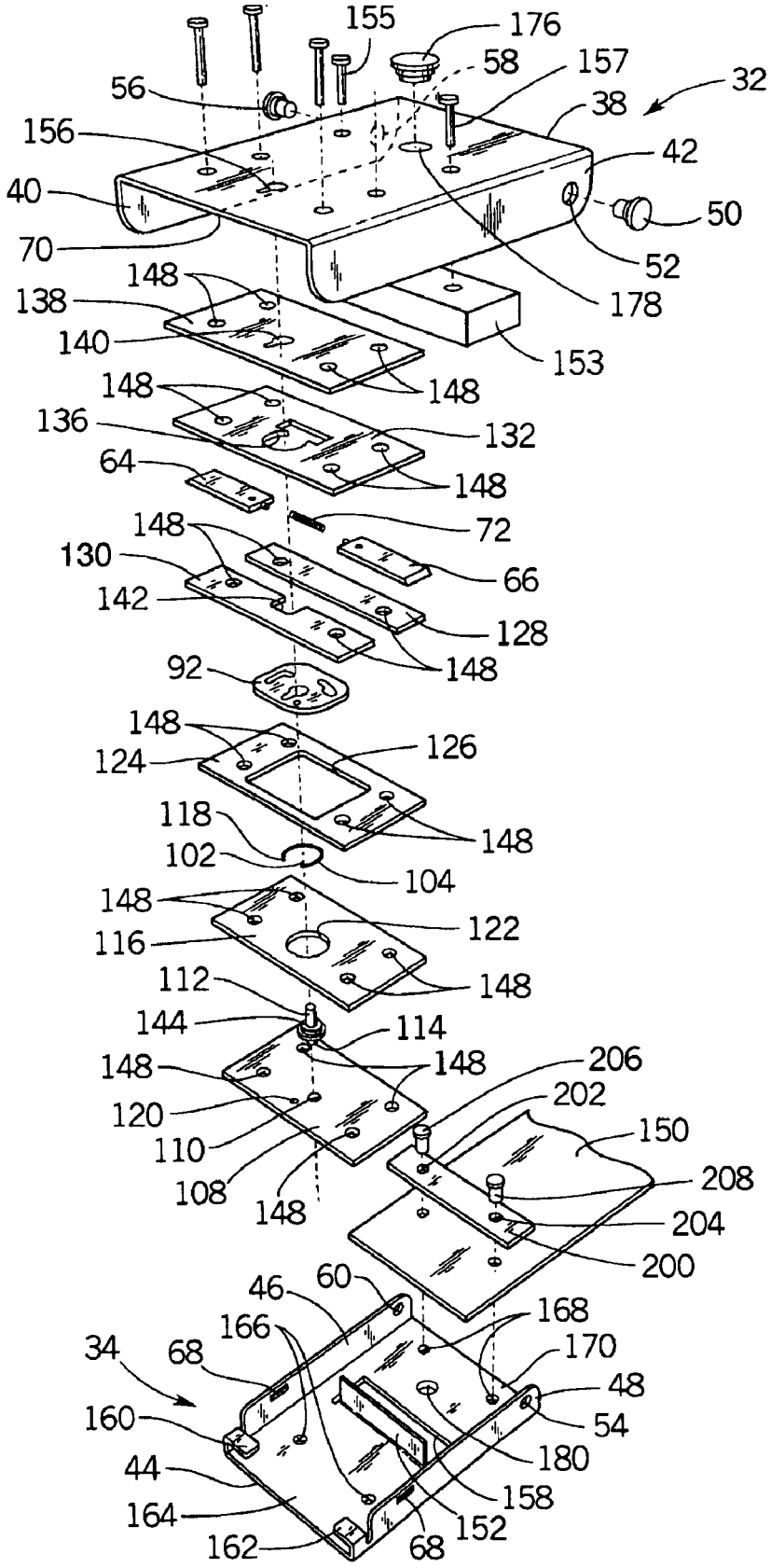
FIG. 9 is an exploded perspective view of the buckle shown in FIG. 4A.

FIG. 9 illustrates the manner in which straps 20, 22 and 24 are mounted to buckles 16 and 18. Buckle 18 is unlocked and opened, and one end 150 of the strap is riveted to section 44 of base 34 using rivets 206 and 208 and bar 200. Strap 26 is riveted to section 44 of each buckle 18 of ankle restraint system 12 through all four holes 166 and 168 formed in section 44. Care must be taken to ensure that the strap lays flat against section 44 and belt wall 152 and support bar 153, as is shown in FIG. 4C.

The manner of securing the free (un-riveted) end of a strap using a buckle and adjusting the strap around the waist, wrist or ankle of a detainee will be described with reference to waist belt 20 and a buckle 18. The procedure is the same with respect to all the straps and buckles of systems 10 and 12. Buckle 18 is unlocked, and upper base 32 is rotated with respect to lower base 34 until buckle 18 is open far enough that end 150 of belt 20 can be inserted into buckle 18 through the space between lower base 34 and the bottom stud plate 108 of lock assembly 106. Belt 20 is pulled through buckle 18 until it is secured tightly around the waist of the detainee. Upper base 32 is then rotated toward lower base 34 until elements 64 and 66 are forced against sides 46 and 48 of lower base 34. As movement of upper base 32 toward lower base 34 continues, the beveled construction of ends 88 and 90 of elements 64 and 66, respectively, cause elements 64 and 66 to move toward each other against the force of spring 78 until ends 88 and 90 reach openings 68 in walls 46 and 48 of lower base 34, at which point spring 78 moves elements 64 and 66 away from each other until ends 88 and 90 enter openings 68, and locking mechanism 62 reaches its locking position, and buckle 18 is locked. Belt wall 152, support bar 153 and edge 154 of lock assembly 106 trap belt 20 in place by creating a tortuous path for belt 20. In this position, belt 20 is trapped, and cannot be slid with respect to buckle 18 in either direction. To unlock buckle 18, the handcuff key is inserted through key opening 156, the hollow end of the key is fit over stud 112, and, with the key fully inserted into locking mechanism 106, the key is rotated to cause elements 64 and 66 to be withdrawn from openings 68. Upper base 32 is moved away from lower base 34 at least until belt wall 152 and support bar 153 clear edge 154 of lock assembly 106 and the tortuous path is eliminated. Belt 20 can then be slid with respect to buckle 18 either to tighten or loosen belt 20 around the detainee, or to remove end 150 of belt 20 from within buckle 18 altogether.

Wrist restraint system 10 is formed by riveting one end of belt 20 to end 170 of lower base 34 at openings 168 using bar 200. The remaining, free, end of belt 20 is then inserted through end 172 of an unlocked buckle 14 and through buckle 14. The free end is then inserted through end 174 of a second unlocked buckle 14 and through end 174 of buckle 18. Buckles 14 are slid on belt 20 until they reach the desired location, and then they can be locked in place. To reposition a buckle 14, buckle 14 is unlocked and slid on belt 20 until the new desired position is reached, at which point buckle 14 is again locked. Each wrist restraint is formed by inserting the free end of a wrist strap 22 and 24 into and through an unlocked buckle 16, and pulling the free end until strap 22 or 24 is secured around the detainee's wrist. Buckle 16 is then locked. Restraints 22 and 24 can be tightened, loosened or completely unbuckled in the same manner as belt 20 is loosened, tightened or unlocked.

Figure 3A:
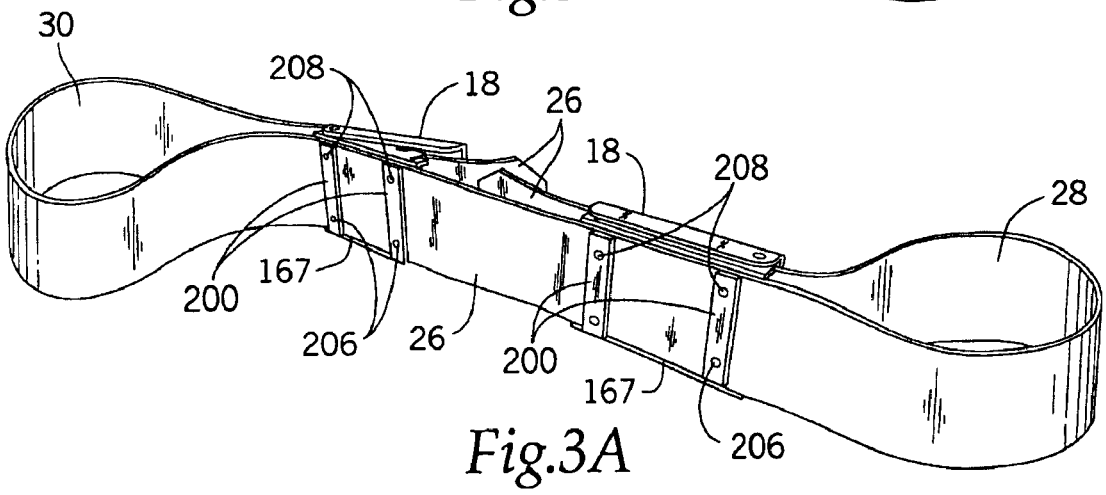
FIG. 3A is a rear view of the system shown in FIG. 3.

Leg restraint system 12 is formed by riveting strap 26 to the rear surface 167 of base 34 of each of a pair of buckles 18 with rivets 206 and 208 through holes 166 and 168 in base 34 and holes 202 and 204 of a pair of bars 200 intermediate the ends of strap 26, as is shown in FIG. 3A. In so doing, strap 26 has two free ends. Each free end of strap 26 is formed into a loop 28 or 30, and each free end is inserted into end 174 of the unlocked buckles 18. Loops 28 and 30 can then be tightened around the detainee's ankles. Loops 28 and 30 can be tightened, loosened or completely unbuckled in the same manner as belt 20 is loosened, tightened or unlocked.

Leg restraint system 12 can also be used as "handcuffs." That is, leg restraint system 12 can be used to restrain the hands of a detainee where it is not necessary to secure the detainee's hands to the detainee's waist area. For example, system 12 can be used to restrain a detainee's hands around a fixed bar or similar element. In this instance, loops 28 and 30 are secured around the detainee's wrists in the same manner as loops 28 and 30 are secured around the detainee's ankles. The only difference is that strap 26 is typically much shorter when system 12 is used as a pair of handcuffs than it is when it is used as a leg restraint, since only 2 or 3 inches typically separate handcuffed hands. System 12 also can be used as shoulder restraints.

Additional changes may be made to the design of the invention. These variations should not be considered as a departure from the subject invention.

What is claimed is:

1. A restraint system comprising:

a lockable, adjustable waist strap;

said waist strap including a first lockable fastener adapted to be locked to mount said waist strap to and prevent removal of said waist strap from a person, and unlocked to remove said waist strap from a person;

a pair of soft wrist restraints; and a second lockable fastener operatively associated with each said wrist restraint to rotatably mount said wrist constraint to said waist strap and to allow said wrist restraint to be repositioned and relocked along said waist strap.

2. The restraint system recited by claim 1 wherein said first lockable fastener is a lockable buckle.

3. The restraint system recited by claim 1 wherein each said wrist restraint is a strap.

4. The restraint system recited by claim 1 wherein said lockable fastener is a lockable buckle.

5. The restraint system recited by claim 4 wherein each said wrist restraint is a strap.

6. A restraint system comprising:

an anchor that can be mounted to the torso of a person;

a first lockable fastener operatively associated with said anchor adapted to be locked to mount said anchor to and prevent removal of said anchor from a person, and unlocked to remove said anchor from a person;

a pair of wrist restraints; and a second lockable fastener operatively associated with each said wrist restraint to rotatably mount said wrist constraint to said anchor, wherein each said second lockable fastener comprises:

a buckle unit, each said buckle unit including a pair of buckles that are mounted to each other for rotational movement relative to each other, said buckle unit being adapted to be locked to mount said wrist restraint to and prevent removal of said wrist restraint from the wrist of a person, and unlocked to remove said wrist restraint from the wrist of a person.

7. A restraint system comprising:

a waist belt that can be mounted to the torso of a person;

a first lockable buckle operatively associated with said waist belt adapted to be locked to mount said waist belt to and prevent removal of said waist belt from a person, and unlocked to remove said waist belt from a person;

a pair of wrist straps; and a second lockable buckle operatively associated with each said wrist strap to rotatably mount said wrist strap to said waist belt;

wherein said second lockable buckle comprises:

a buckle unit, each buckle unit including a pair of buckles that are mounted to each other for rotational movement relative to each other, said buckle unit being adapted to be locked to mount said wrist strap to and prevent removal of said wrist strap from the wrist of a person, and unlocked to remove said wrist strap from the wrist of a person.

8. A restraint system comprising:

a waist belt;

a lockable buckle operatively associated with said waist belt adapted to be locked to mount said waist belt to and prevent removal of said waist belt from the torso of a person, and unlocked to remove said waist belt from the torso of a person;

a pair of wrist straps;

a buckle unit operatively associated with each said wrist strap to rotatably mount said wrist strap to said waist belt, each said buckle unit including a pair of buckles that are mounted to each other for rotational movement relative to each other, said buckle unit being adapted to be locked to mount said wrist restraint to and prevent removal of said wrist restraint from the wrist of a person, and unlocked to remove said wrist restraint from the wrist of a person, each said buckle unit being capable of being unlocked to slide said buckle along said waist belt and then locked to lock said buckle to a new position on said waist belt to reposition along said waist belt a hand restrained by said wrist strap.

9. A limb restraint system comprising:

a strap; and a pair of lockable buckles that are used to form said strap into a pair of limb restraints, each of said buckles being adapted to be locked to mount a said limb restraint to and prevent removal of said limb restraint from the limb of a person, and unlocked to remove said limb restraint from the limb of a person;

each said buckle including:

a housing that can be moved between open and closed positions, said housing being adapted to receive a strap segment when said housing is in the open position; and a lock for selectively locking said housing in the closed position and unlocking said housing to permit moving said housing from the closed position to the open position;

said housing defining a tortuous path when said housing is closed;

said housing confining the strap segment within said tortuous path without binding the strap segment when said housing has received the strap segment and said housing is closed and locked, said strap segment being prevented from sliding with respect to said housing when said strap segment is confined within said housing by binding areas that are defined by said housing and that bind the strap segment only when the strap segment starts to move through said tortuous path to prevent said movement of the strap segment through said tortuous path.

10. A lockable belt fastener comprising:

a housing that can be moved between open and closed positions, said housing being adapted to receive a strap segment when said housing is in the open position; and a lock for selectively locking said housing in the closed position and unlocking said housing to permit moving said housing from the closed position to the open position;

said housing defining a tortuous path when said housing is closed;

said housing confining the strap segment within said tortuous path without binding the strap segment when said housing has received the strap segment and said housing is closed and locked, said strap segment being prevented from sliding with respect to said housing when said strap segment is confined within said housing by binding areas that are defined by said housing and that bind the strap segment only when the strap segment starts to move through said tortuous path to prevent said movement of the strap segment through said tortuous path.

11. The belt fastener recited by claim 10 wherein said binding areas are corners defined by said housing.

* * * * *